US009560952B2

(12) United States Patent
Clark

(10) Patent No.: US 9,560,952 B2
(45) Date of Patent: Feb. 7, 2017

(54) UTENSIL CLEANING DEVICE AND METHOD

(71) Applicant: SANI-BLADE, LLC, Richmond, VA (US)

(72) Inventor: John Clark, Richmond, VA (US)

(73) Assignee: SANI-BLADE, LLC, Richmond, VA (US)

( * ) Notice: Subject to any disclaimer, the term of this patent is extended or adjusted under 35 U.S.C. 154(b) by 129 days.

(21) Appl. No.: 14/580,186

(22) Filed: Dec. 22, 2014

(65) Prior Publication Data

US 2015/0246378 A1 Sep. 3, 2015

Related U.S. Application Data

(60) Provisional application No. 61/946,739, filed on Mar. 1, 2014.

(51) Int. Cl.

| | |
|---|---|
| ***B08B 3/12*** | (2006.01) |
| ***A47L 15/42*** | (2006.01) |
| ***A47L 15/37*** | (2006.01) |
| *A47L 15/00* | (2006.01) |

(52) U.S. Cl.

CPC ..... *A47L 15/4242* (2013.01); *A47L 15/0015* (2013.01); *A47L 15/37* (2013.01); *A47L 15/0089* (2013.01); *A47L 2601/10* (2013.01)

(58) Field of Classification Search

CPC .. A47L 15/0015; A47L 15/37; A47L 15/0098; A47L 2601/11

USPC ..... 134/1, 56, 144, 152; 15/104, 160, 220.4, 15/221, 104.92, 308, 327, 104.921

See application file for complete search history.

(56) References Cited

U.S. PATENT DOCUMENTS

| | | | | |
|---|---|---|---|---|
| 1,598,443 | A | 8/1926 | Horan | |
| 5,652,993 | A | 8/1997 | Kreyer | |
| 6,663,309 | B2 * | 12/2003 | Zamansky | B43M 11/06 401/205 |
| 2011/0155924 | A1 * | 6/2011 | Lo | A61L 2/10 250/455.11 |
| 2011/0179593 | A1 * | 7/2011 | Albright | A47L 17/02 15/159.1 |

FOREIGN PATENT DOCUMENTS

| | | |
|---|---|---|
| EP | 1878512 A1 | 1/2008 |
| WO | 2007034466 A1 | 3/2007 |

OTHER PUBLICATIONS

International Search Report and Written Opinion for Appl. No. PCT/US2015/014391, May 14, 2015, 7 pages.

Edlund KSS-5050 Knife Sanitizing System, 2 pages.

* cited by examiner

*Primary Examiner* — Duy Deo
*Assistant Examiner* — Maki Angadi
(74) *Attorney, Agent, or Firm* — Patent Law of Virginia, PLLC; Brian J. Teague

(57) ABSTRACT

A knife cleaner for a commercial kitchen is mounted on a countertop or prep table with suction cups or similar devices, and provides three separate compartments for washing, rinsing, and sanitizing solutions. A removable cap provides a channel guide leading downward into each of the three compartments. The wash channel guide provides scrub brush components to remove food particles and other debris. The cleaner is disassembled easily without tools for cleaning purposes.

6 Claims, 6 Drawing Sheets

UTENSIL CLEANING DEVICE AND METHOD

CROSS-REFERENCE TO RELATED APPLICATIONS

This application claims priority to U.S. Provisional Application Ser. No. 61/946,739, filed Mar. 1, 2014, the contents of which are incorporated herein by reference in its entirety.

FIELD OF THE INVENTION

The present disclosure relates generally to kitchen equipment and accessories, and in particular to a utensil cleaner.

BACKGROUND OF THE DISCLOSURE

In a commercial kitchen, time is of the essence. Keeping food preparation surfaces and utensils clean and sanitary is often a conflicting goal, since cleaning them is very time consuming. In particular, kitchen knives must be kept absolutely clean and free from disease pathogens, which are almost universally present in uncooked meat and seafood, organic produce, and other foods. Kitchen workers are under strict time constraints, may be uneducated regarding food safety standards, and may also face a language barrier. Properly washing, rinsing and sanitizing a knife can take two or three minutes and must be done dozens of times a day, even in a best-case scenario, and wasted time represents money down the drain.

BRIEF SUMMARY OF THE DISCLOSURE

In one embodiment of the invention, a utensil cleaning device comprises an upright fluid-tight housing in which are defined a plurality of fluid-tight chambers, and a lid removably affixable to the housing. The lid has a plurality of recesses defined in the lid, each of the recesses aligned with a corresponding one of the chambers, each recess having an elongated slot defined therein, each slot providing access to a respective one of the chambers.

The device may further comprise a frictional cleaning mechanism mounted below at least one of the slots.

The device may further comprise opposing brushes mounted below at least one of the slots. The opposing brushes may be mounted below at least one of the slots such that distal ends of the opposing brushes are adjacent each other and aligned with the corresponding slot. The opposing brushes may be selectively removably mounted below at least one of the slots.

The device may further comprise a heating element for heating a fluid in at least one of the chambers.

The device may further comprise an ultraviolet light for exposing a fluid in at least one of the chambers to ultraviolet light.

In an alternative embodiment of the invention, a method of cleaning utensils comprises placing a utensil cleaning device on a work surface. The utensil cleaning device comprises an upright fluid-tight housing in which are defined first, second, and third fluid-tight chambers, and a lid removably affixable to the housing. The lid has first, second, and third recesses defined in the lid, each of the recesses aligned with a corresponding one of the chambers, each recess having an elongated slot defined therein, each slot providing access to a respective one of the chambers. The method further comprises placing a mixture of soap and water into the first fluid-tight chamber, placing water into the second fluid-tight chamber, placing a disinfecting solution into the third fluid-tight chamber, affixing the lid to the housing, inserting a distal portion of a utensil to be cleaned into the slot of the first fluid-tight chamber and then removing the distal portion of the utensil from the slot of the first fluid-tight chamber, inserting a distal portion of the utensil into the slot of the second fluid-tight chamber and then removing the distal portion of the utensil from the slot of the second fluid-tight chamber, and inserting a distal portion of the utensil into the slot of the third fluid-tight chamber and then removing the distal portion of the utensil from the slot of the third fluid-tight chamber.

The method may further comprise heating at least one of the mixture of soap and water in the first fluid-tight chamber, the water in the second fluid-tight container, or the disinfecting solution in the third fluid-tight chamber.

The method may further comprise exposing at least one of the mixture of soap and water in the first fluid-tight chamber, the water in the second fluid-tight container, or the disinfecting solution in the third fluid-tight chamber to ultraviolet light.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
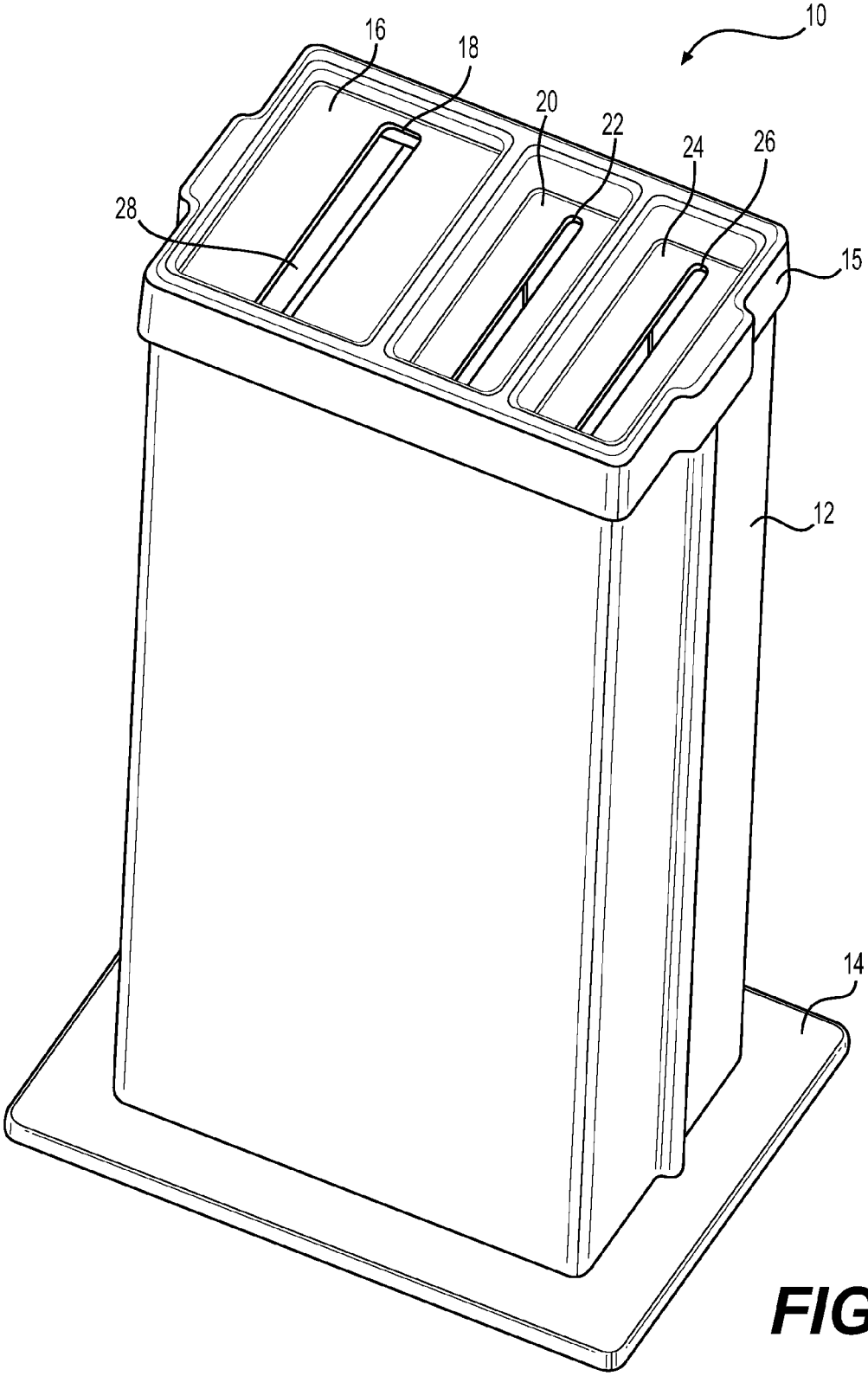
FIG. 1 is a perspective view of a utensil cleaning device, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to a utensil cleaner. Although generically referred to herein as a utensil cleaner, embodiments of the invention will typically be used for cleaning knives. The utensil cleaner of embodiments of the invention may be used wherever desired, but will typically be used in a commercial kitchen (e.g., a restaurant kitchen). The cleaning device may sit or be mounted on a countertop or prep table with suction cups or similar devices. Alternatively, the cleaning device may sit in a recess formed in a countertop or prep table, or may be mounted in a fixture attached to a countertop or prep table. In embodiments of the invention, the cleaning device typically provides three separate compartments for washing, rinsing, and sanitizing utensils (but more or fewer compartments may be used). In that regard, the compartments are fluid-tight and are typically filled, respectively, with soap and water, clean water, and a disinfecting solution. A removable cap provides a channel guide or slot leading downward into each of the three compartments. The channel guide corresponding to the wash compartment may provide scrub brush components to remove food particles and other debris. The cleaning device is disassembled easily without tools for cleaning purposes.

Referring to the drawings in detail, wherein like numerals indicate like elements throughout, FIGS. 1-6 illustrate a utensil (e.g., knife) cleaner 10. The cleaner 10 comprises a generally rectangular cuboid, upright housing 12 on top of a generally rectangular base 14. In one embodiment of the invention, the base 14 of the cleaner 10 sits on a countertop, prep table, or any suitable work surface during use. The underside of the base 14 may have a plurality of suction cups (e.g., four) (not illustrated) or similar devices to secure the cleaner to the work surface. Three separate, upright, side-by-side (other configurations may be used) fluid-tight compartments 30, 32, 34 are defined in the housing 12 for washing, rinsing, and sanitizing solutions. In one exemplary use of the invention, the first compartment 30 is filled with a wash solution (e.g., soap and water), the second compartment 32 is filled with rinse water, and the third compartment 34 is filled with a disinfectant or sanitizing solution.

Figure 4:
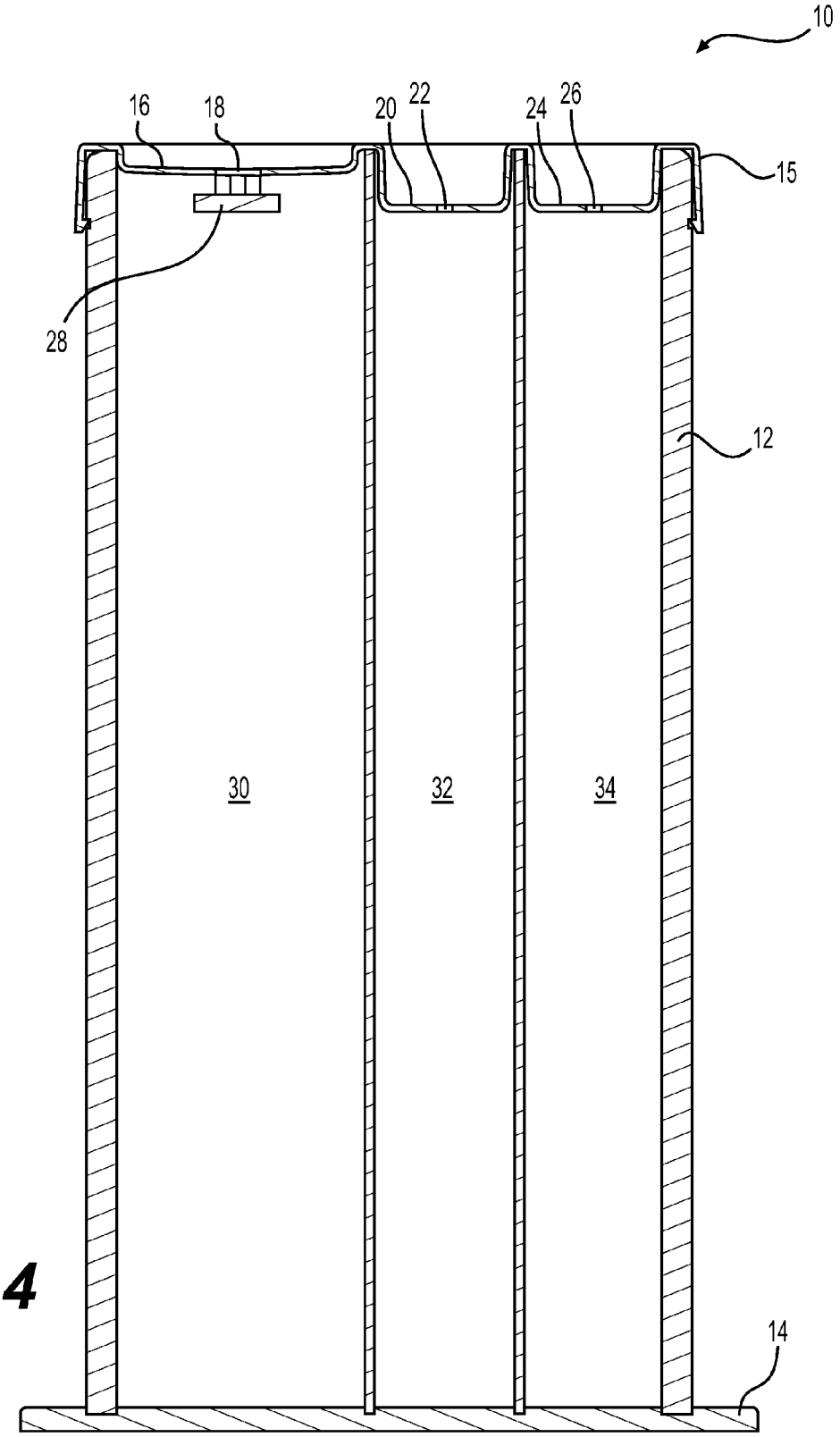
FIG. 4 is a cross-sectional view of view of the utensil cleaning device of FIG. 1.

The cleaner 10 includes a selectively removable lid 15. The lid 15 is affixable to the top edge of the housing 12, as seen in FIGS. 1 and 4. The lid 15 may be removed to fill or empty the compartments 30, 32, 34 or to clean the housing 12 or the lid 15. The lid 15 is affixed to the housing 12 during use of the cleaner 10. The lid 15 comprises three recesses 16, 20, 24 defined in the top surface of the lid 15. Each of the recesses 16, 20, 24 is aligned with a corresponding one of the chambers 30, 32, 34, and projects downward into its respective chamber when the lid 15 is on the housing 12. Each of the recesses 16, 20, 24 has an elongated channel guide or slot 18, 22, 26 defined therein providing access to a respective one of the chambers when the lid 15 is on the housing 12. Specifically, first recess 16 defines first slot 18 which provides access to first compartment 30; second recess 20 defines second slot 22 which provides access to second compartment 32; and third recess 24 defines third slot 26 which provides access to third compartment 34. The recesses are important because the recesses allow the compartments to be filled with fluid up to (or even slightly above) the level of the slots, without the fluid overflowing out of the compartments. Filling the compartments with fluid up to the level of the slots enables a larger portion of the utensil (e.g., knife blade) to come in contact with the fluids and be properly cleaned and sanitized.

Figure 2:
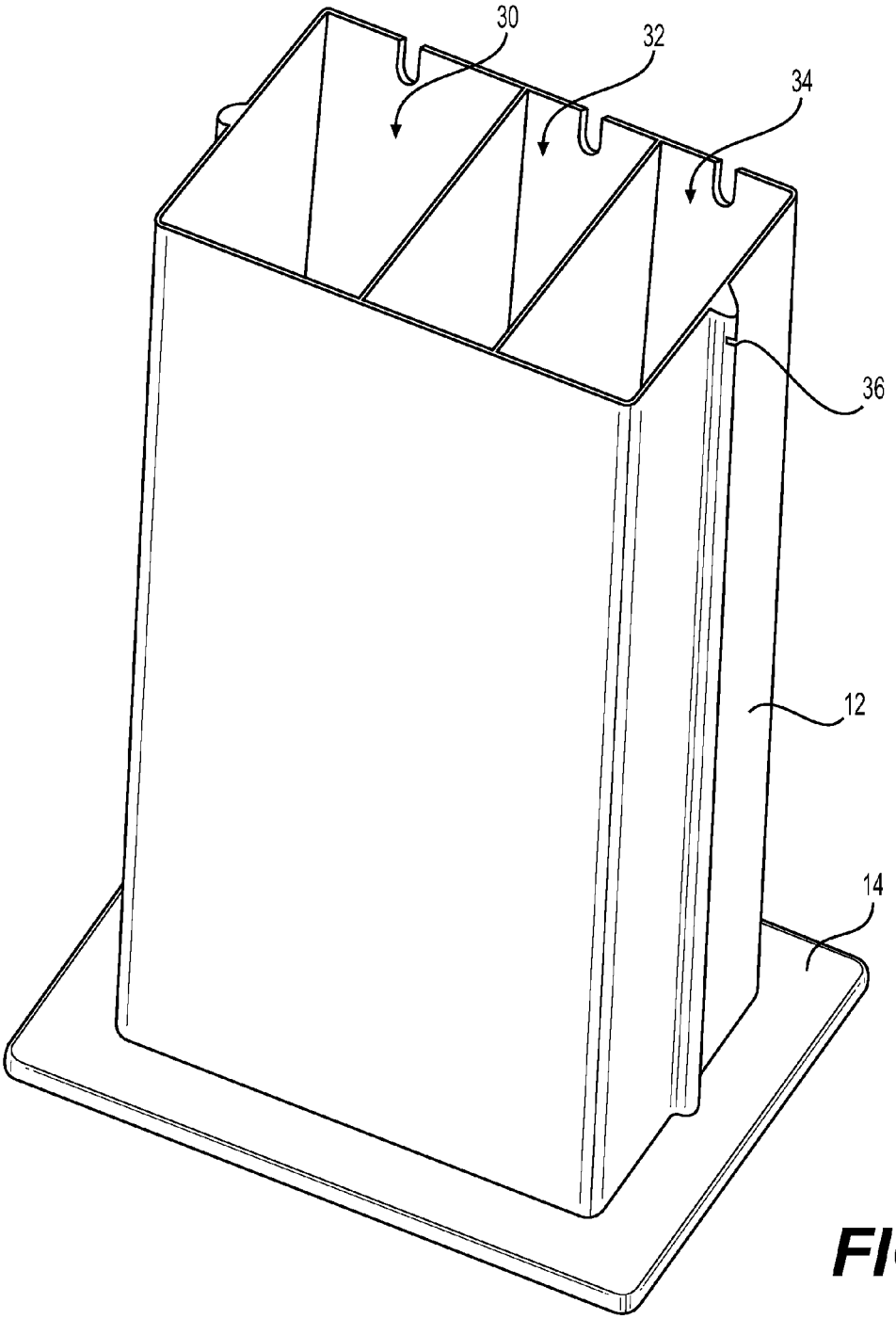
FIG. 2 is a perspective view of the utensil cleaning device of FIG. 1 with the cap removed.
Figure 3:
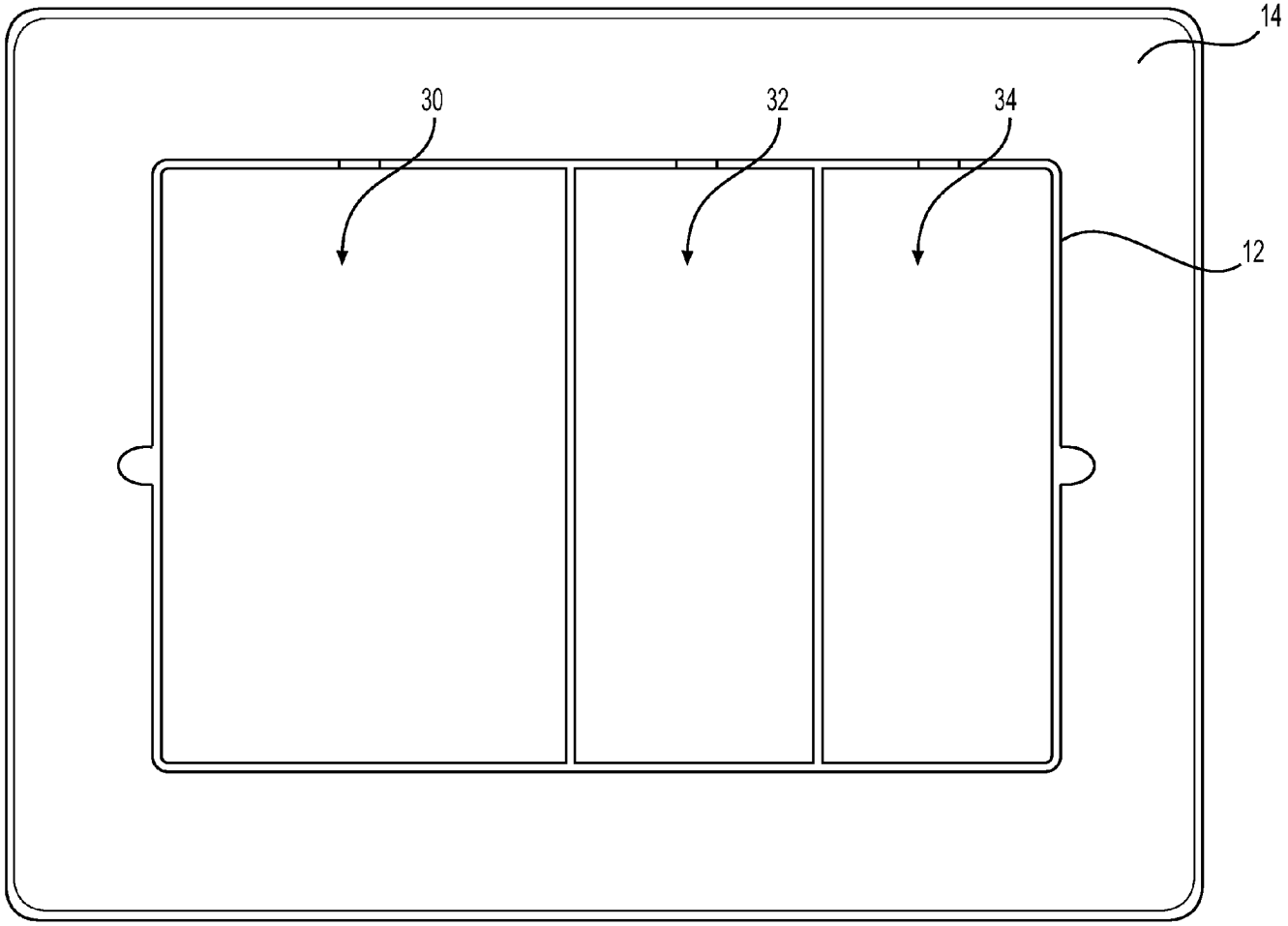
FIG. 3 is a top view of the utensil cleaning device of FIG. 1 with the cap removed.

When the lid 15 is mounted on the housing 12, protrusions 38 on opposing sides of the lid (seen in FIG. 5) engage corresponding slots 36 on opposing sides of the housing (one of which is seen in FIG. 2) to help retain the lid on the housing but allow the cleaner 10 to be disassembled easily without tools.

Figure 5:
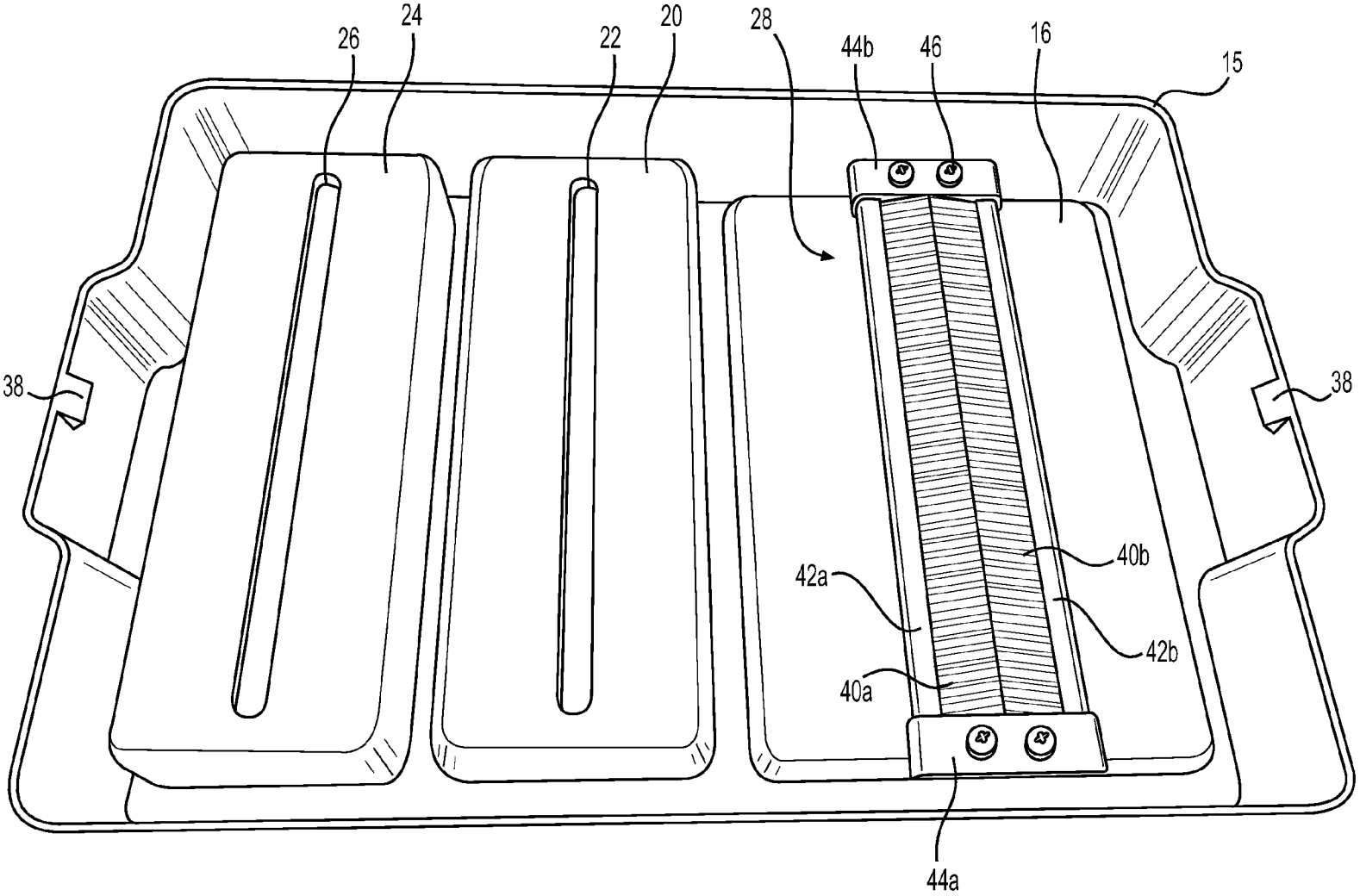
FIG. 5 is a perspective view of the underside of the cap of the utensil cleaning device of FIG. 1.
Figure 6:
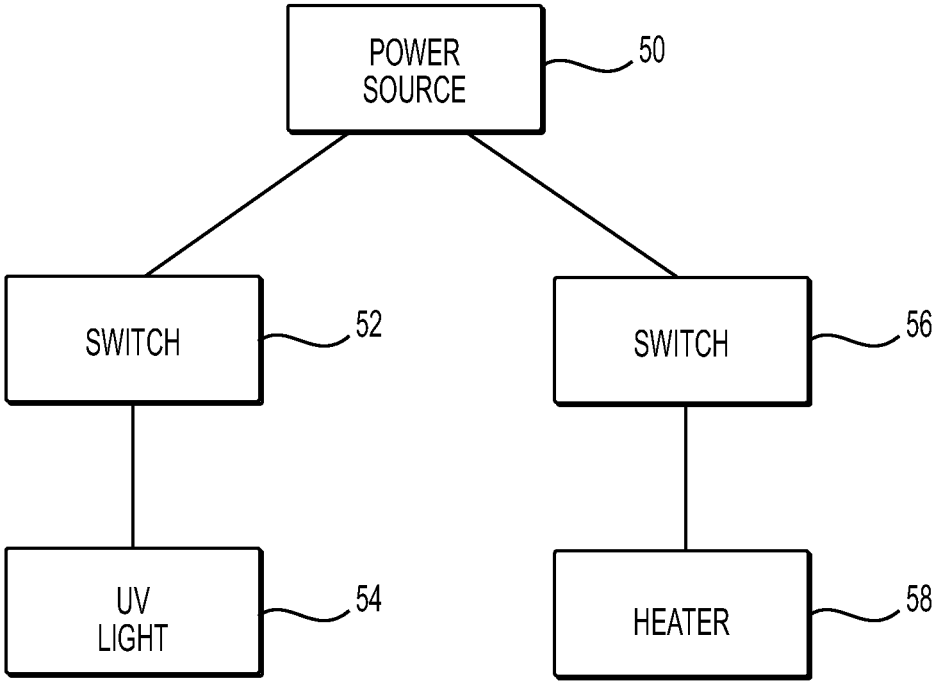
FIG. 6 is a block diagram of optional components of the utensil cleaning device of FIG. 1.

A frictional cleaning mechanism may be mounted above or below at least one of the slots. Such a frictional cleaning mechanism helps remove food particles and other debris from the utensil that might not be removed just by coming in contact with the fluids. In the illustrated embodiment of the invention, a brush assembly 28 is mounted below and is aligned with the first slot 18. The brush assembly 28 comprises opposing brushes 40*a*, 40*b* (which each comprise a plurality of bristles), each mounted in a respective U-channel 42*a*, 42*b*, as seen in FIG. 5. The ends of the U-channels 42*a*, 42*b* are secured in end brackets 44*a*, 44*b* which are in turn secured to the underside of lid 15, thereby securing the entire brush assembly 28 to the underside of lid 15. The end brackets 44*a*, 44*b* are secured to the underside of lid 15 using any suitable mechanism, such as screws 46. The brush assembly is typically selectively removably mounted to the lid. In alternative embodiments of the invention, clips (not illustrated) or other similar devices may be used to secure the brush assembly to the lid, such that the brush assembly may be more easily removed from the lid for cleaning or replacement. In alternative embodiments of the invention, the frictional cleaning mechanism comprises opposing flexible, "squeegee"-type blades.

As seen in FIG. 5, the opposing brushes are mounted such that the distal ends of the opposing brushes are adjacent each other, and preferably in contact with each other to apply a frictional cleaning force to even very thin utensils. The brush assembly is mounted such that the distal ends of the opposing brushes are generally parallel to the corresponding slot and typically aligned with the central axis of the corresponding slot.

In alternative embodiments of the invention, the cleaner may comprise an electric heating element 58 (likely housed in the base 14) to keep any or all three of the solutions hot. Such a heater may receive electric power from a power source 50 via a switch 56. Alternative embodiments of the invention may comprise one or more ultraviolet (UV) lights 54 to expose one or more of the fluids to UV light for disinfecting purposes. Such a UV light may receive electric power from a power source 50 via a switch 52. Power source 50 may comprise a battery or an AC electric outlet.

The size and shape of the cleaner may vary as desired. In one exemplary embodiment of the invention, the overall dimensions of the device, excluding the suction cups, are 14.5 inches tall, 9 inches wide, and 4 inches deep. In such an embodiment, the dimensions of the channel guides may be 3.5 inches long and 0.5 inches wide.

The body 12, the base 14, and the cap 16 may be constructed from any suitable rigid, durable materials which are corrosion resistant and easily cleaned, such as stainless steel, aluminum or aluminum alloy, acrylic polymer, plastic, or combinations thereof. The body 12, the base 14, and the cap 16 may be constructed from materials that have antimicrobial properties, such as copper-embedded polymer. The suction cups may be constructed from any suitable flexible, durable material, such as rubber or silicone. The brush components may be constructed from any suitable semi-rigid, durable material, such as plastic or nylon. Alternatively, the brush assembly may comprise rubber or silicon "squeegee"-type blades.

To use the illustrated embodiment of the invention, a user places the cleaner 10 on a work surface, such as a countertop or prep table. The cleaner 10 may be secured to the work surface, such as by using suction cups (not illustrated) which may be affixed to the underside of the base 14 of the cleaner 10. The user then fills the three internal compartments 30, 32, 34 in the body 12 with hot wash solution, hot rinse water, and sanitizing solution, respectively, and affixes the cap 15 to the top of the body 12. During the course of food preparation, the user inserts the blade of a knife (not illustrated) into the first slot 18, immersing the blade in the hot wash solution, and withdraws the blade, scouring it against the scrub brush 28. This process of insertion and withdrawal may be repeated as necessary until the blade is visibly clean and free from food particles, stains, and other debris. The user then inserts the blade of the knife into the second slot 22, immersing the blade in the hot rinse water, then withdraws the blade. Finally, the user inserts the blade of the knife into the third slot 26, immersing the blade in the hot sanitizer solution, then withdraws the blade.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A method of cleaning utensils, the method comprising:

placing a utensil cleaning device on a work surface, the utensil cleaning device comprising:

(i) an upright fluid-tight housing in which are defined first, second, and third fluid-tight chambers;

(ii) a lid removably affixable to the housing, the lid having first, second, and third recesses defined in the lid, each of the recesses aligned with a corresponding one of the chambers, each recess having an elongated slot defined therein, each slot providing access to a respective one of the chambers; and (iii) opposing brushes mounted to an underside of the lid below at least one of the slots;

placing a mixture of soap and water into the first fluid-tight chamber;

placing water into the second fluid-tight chamber;

placing a disinfecting solution into the third fluid-tight chamber;

affixing the lid to the housing;

inserting a distal portion of a utensil to be cleaned into the slot of the first fluid-tight chamber and then removing the distal portion of the utensil from the slot of the first fluid-tight chamber;

inserting a distal portion of the utensil into the slot of the second fluid-tight chamber and then removing the distal portion of the utensil from the slot of the second fluid-tight chamber; and inserting a distal portion of the utensil into the slot of the third fluid-tight chamber and then removing the distal portion of the utensil from the slot of the third fluid-tight chamber.

2. The method of claim 1, wherein the utensil cleaning device further comprises:

a frictional cleaning mechanism mounted to the underside of the lid below at least one of the slots.

3. The method of claim 1, wherein the opposing brushes are mounted to the underside of the lid below at least one of the slots such that distal ends of the opposing brushes are adjacent each other and aligned with the corresponding slot.

4. The method of claim 3, wherein the opposing brushes are selectively removably mounted to the underside of the lid below at least one of the slots.

5. The method of claim 1, further comprising:

heating at least one of the mixture of soap and water in the first fluid-tight chamber, the water in the second fluid-tight container, or the disinfecting solution in the third fluid-tight chamber.

6. The method of claim 1, further comprising exposing at least one of the mixture of soap and water in the first fluid-tight chamber, the water in the second fluid-tight container, or the disinfecting solution in the third fluid-tight chamber to ultraviolet light.

* * * * *